US006795035B2

(12) United States Patent
Jocher

(10) Patent No.: US 6,795,035 B2
(45) Date of Patent: Sep. 21, 2004

(54) SYSTEM FOR ANTENNA SIDELOBE MODIFICATION

(75) Inventor: Ronald W. Jocher, East Hanover, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 10/107,441

(22) Filed: Mar. 28, 2002

(65) Prior Publication Data

US 2003/0184491 A1 Oct. 2, 2003

(51) Int. Cl.[7] ..... H01Q 21/12
(52) U.S. Cl. ..... 343/815; 343/817
(58) Field of Search ..... 343/815, 816, 343/817, 818, 838, 839, 892

(56) References Cited

U.S. PATENT DOCUMENTS 4,841,308 A * 6/1989 Terakawa et al. ..... 343/771
5,039,994 A * 8/1991 Wash et al. ..... 343/813
5,111,214 A * 5/1992 Kumpfbeck et al. ..... 343/841
5,469,181 A * 11/1995 Yarsunas ..... 343/815
5,710,569 A * 1/1998 Oh et al. ..... 343/817
5,896,107 A * 4/1999 Huynh ..... 343/700 MS
5,909,195 A * 6/1999 Merenda ..... 343/815
6,195,063 B1 * 2/2001 Gabriel et al. ..... 343/797

* cited by examiner

*Primary Examiner*—Tho Phan

(57) ABSTRACT

Disclosed is a side-lobe-modification antenna system comprising: an antenna including a base plate and an RF radiating arrangement attached to the base plate; and a side-lobe modifier bracket having a first planar surface and a second planar surface intersecting the first planar surface. The second planar surface can extend aside the base plate at an angle relative to the first planar surface. The first planar surface can be parallel to and abut the base plate.

27 Claims, 9 Drawing Sheets

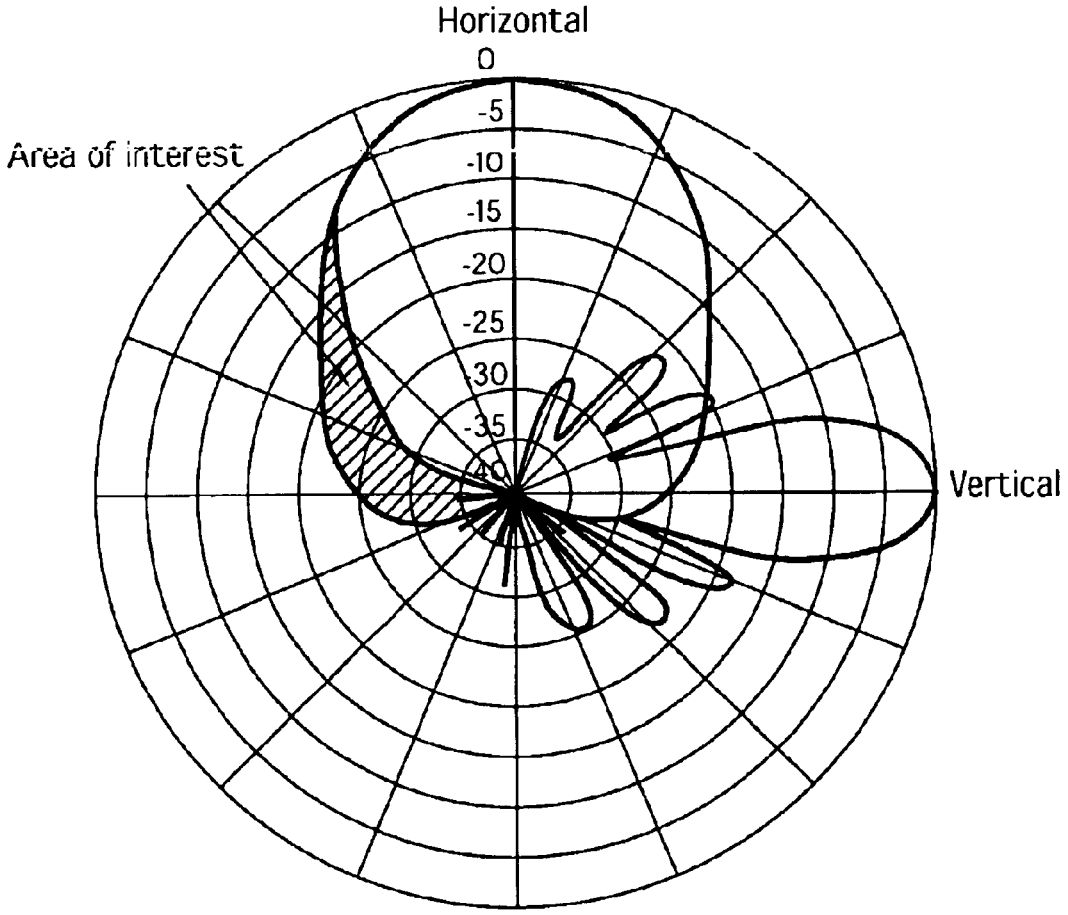
FIG. 4 Antenna Radiation Pattern

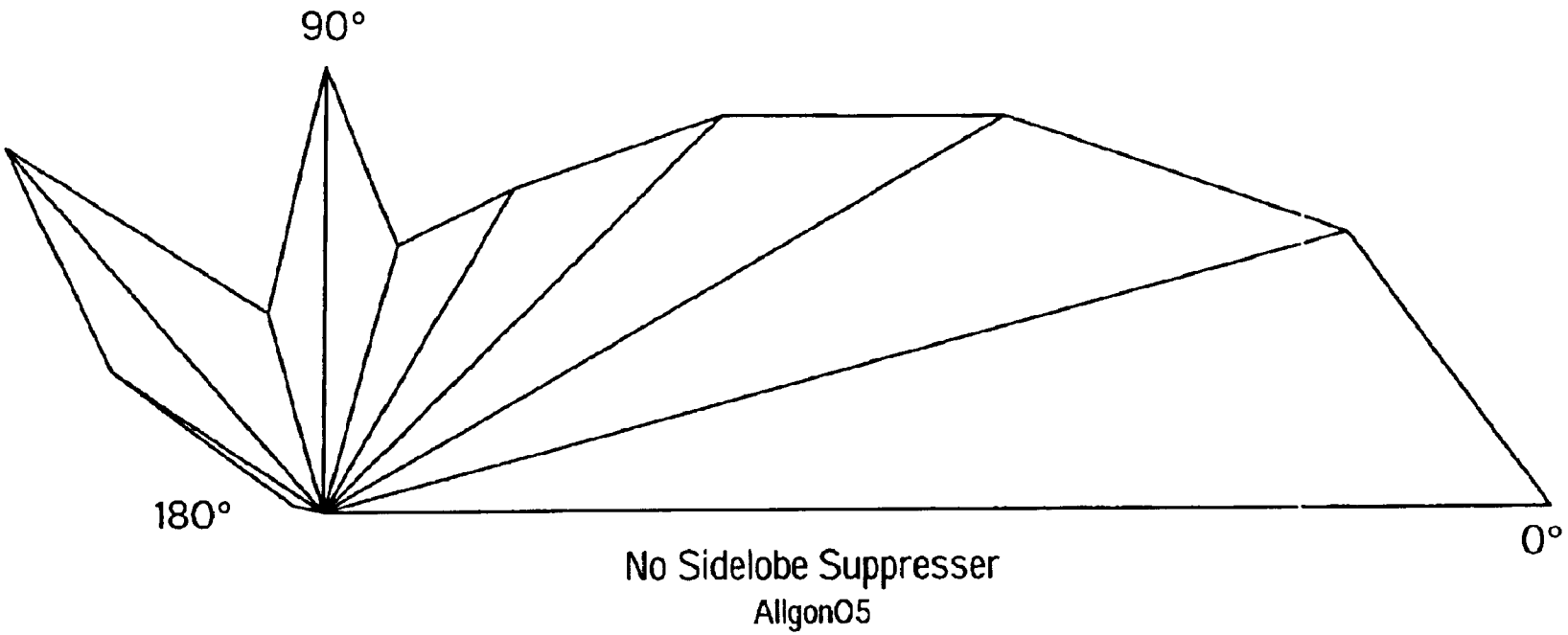
FIG. 5 No Sidelobe Reducer

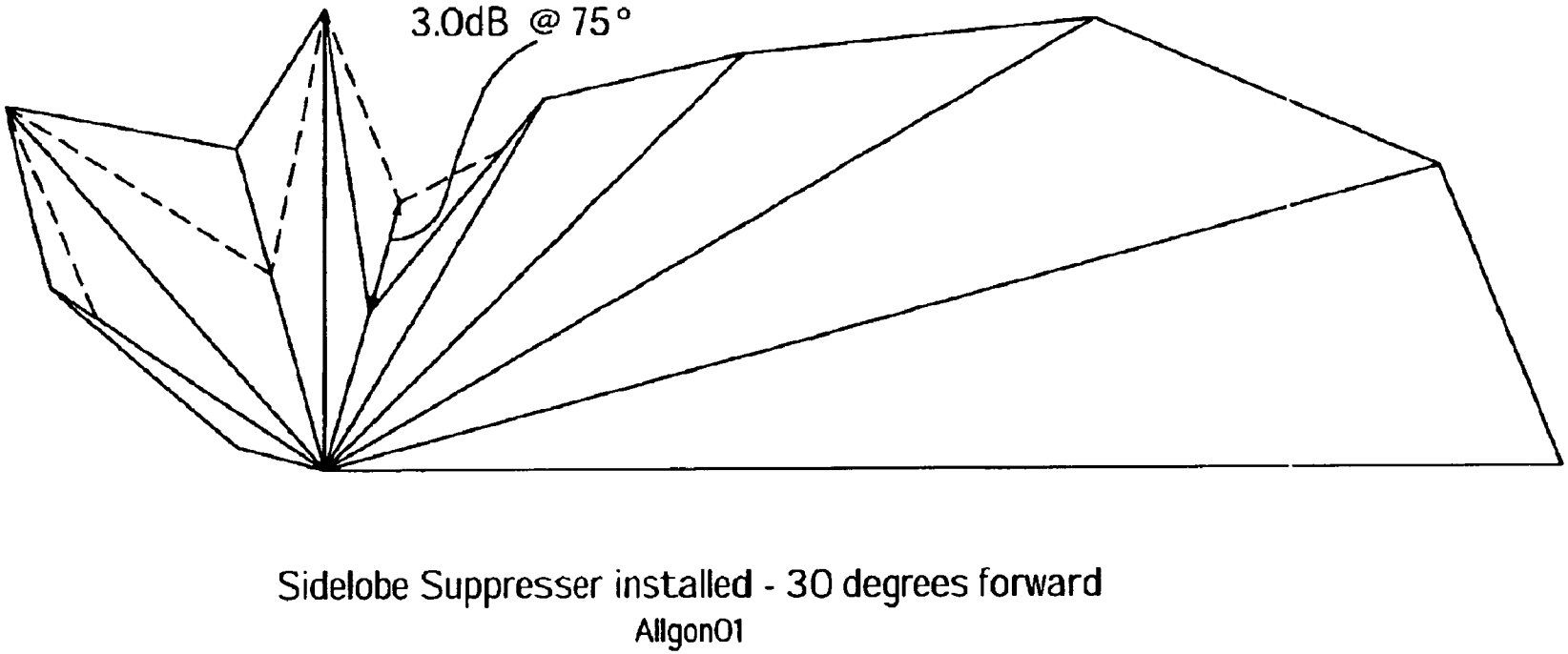
FIG. 6 Sidelobe Reducer Installed 30 Degrees Forward

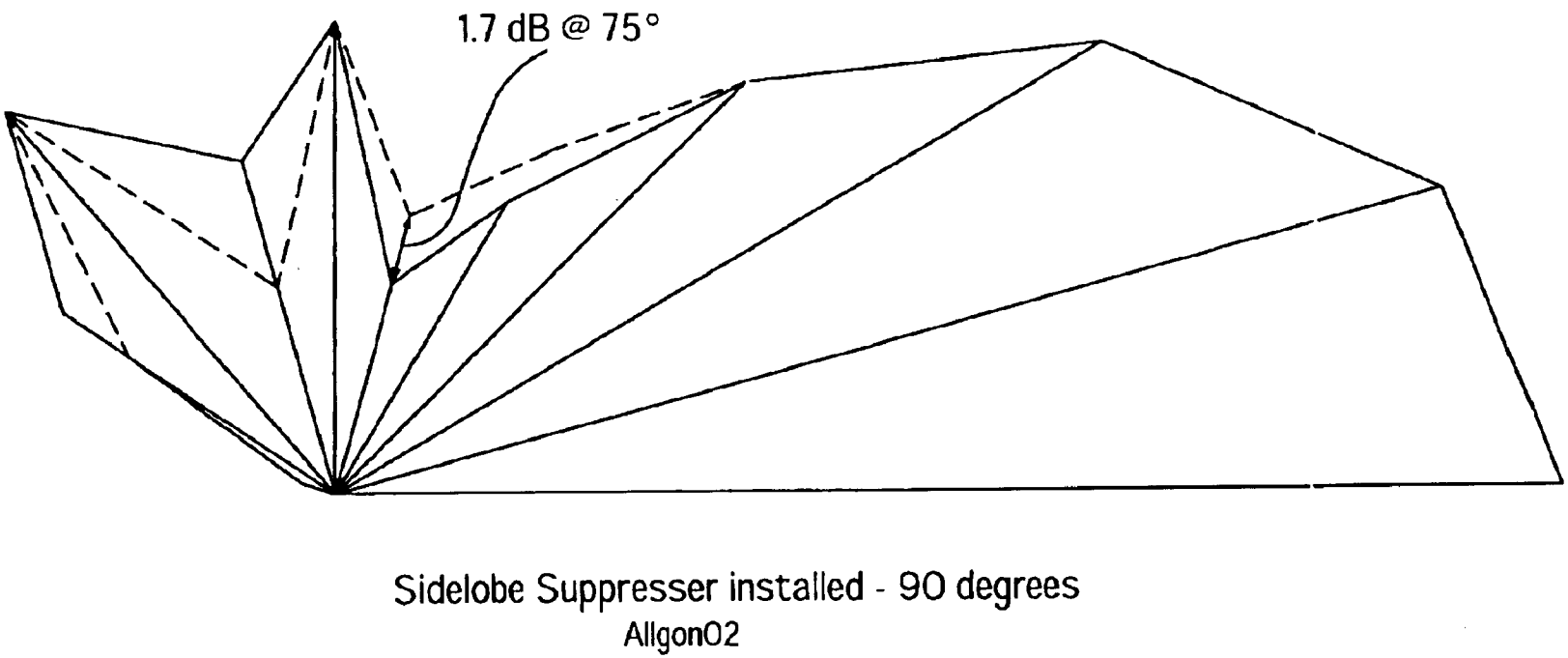
FIG. 7 Sidelobe Reducer Installed at 90 Degrees

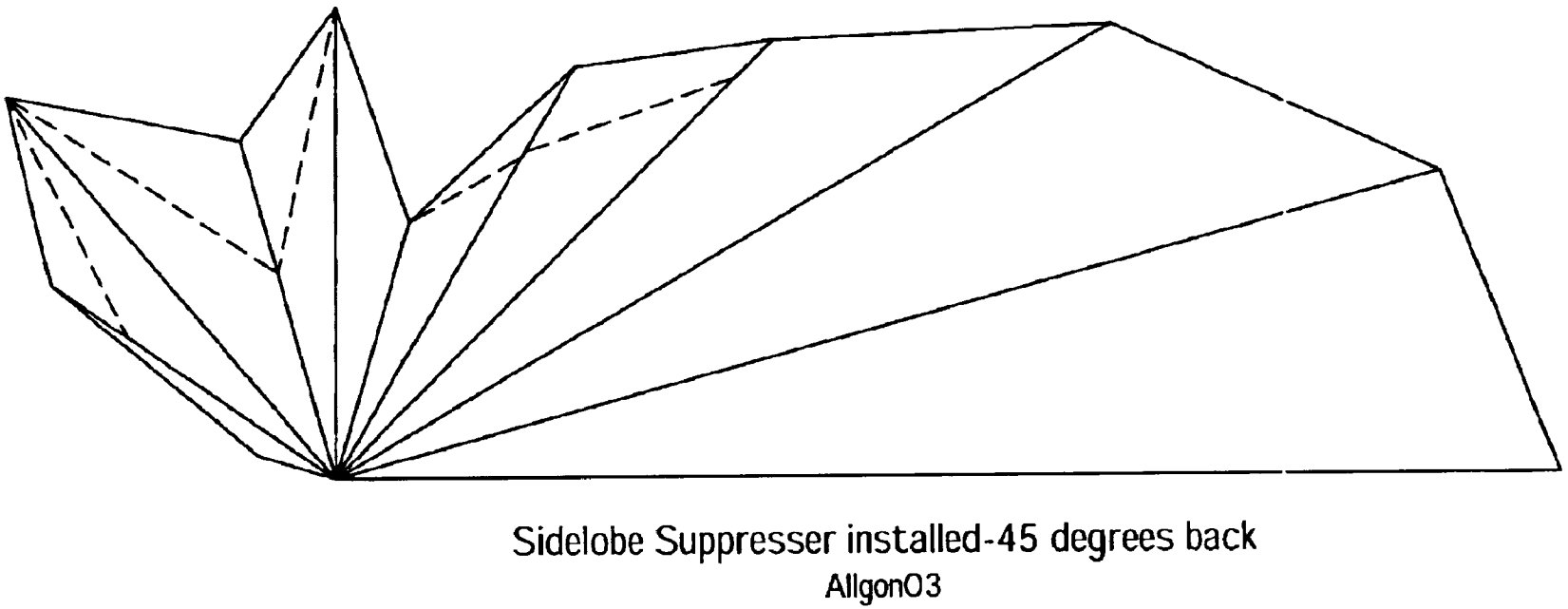
FIG. 8 Sidelobe Reducer Installed 45 Degrees Back

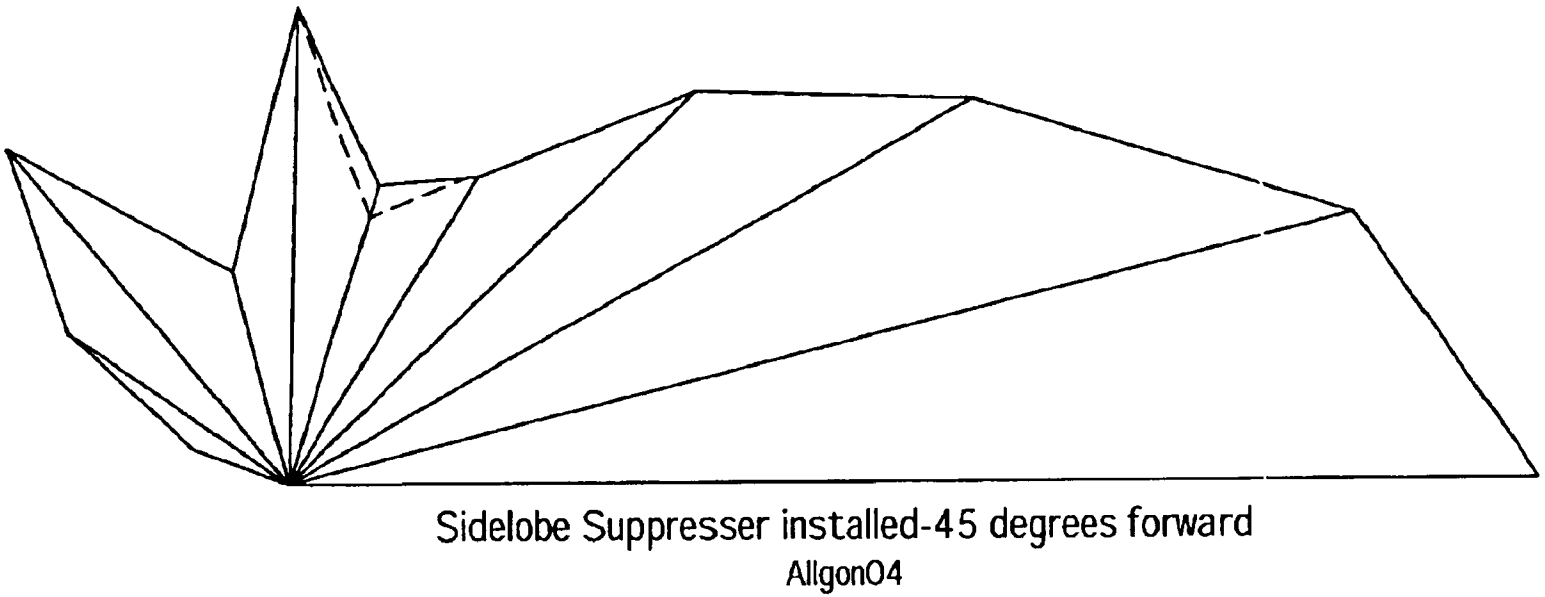
FIG. 9 Sidelobe Reducer Installed 45 Degrees Forward

SYSTEM FOR ANTENNA SIDELOBE MODIFICATION

FIELD OF THE INVENTION

The invention is directed to an antenna system, and more particularly to an antenna system for modification of one or more sidelobe radiation patterns.

BACKGROUND OF THE INVENTION

Antennas that radiate electromagnetic energy in the radio frequency spectrum are referred to as RF antennas. As a practical matter, earthly constraints make it impossible to achieve a perfect RF radiator.

RF antennas are typically metallic. During radiation, electromagnetic currents are present on the metallic surfaces of the antenna. These currents arise from multiple sources such as current spillover and diffraction from the main antenna radiating pattern. Additionally, a mismatch of the antenna feedpoint impedance with that of the transmission line characteristic impedance causes common mode RF currents on the metallic surfaces. The common mode currents and scatter can effect the overall radiation pattern of an antenna. Usually, the effect is undesired, taking the form of a sidelobe on an azimuthal plot of the antenna's radiation pattern.

RF transmitting antennas for wireless communication systems, e.g., base station antennas, are becoming more and more common. In other words, the population density of RF transmitting antennas has steadily increased with no signs that the this trend will change any time soon.

SUMMARY OF THE INVENTION

The invention, in part, is a recognition of the problem that as population density of RF transmitting antennas increase, there is a point at which the side-lobe radiation pattern of one antenna can negatively affect one or more proximate antennas (be it a receiving antenna or another transmitting antenna), or other unintended structures or systems. Examples of such a situation include the placing of a wireless telephone base station transmitting antenna proximate to wireless mobile unit testing laboratories (where excessive ambient RF energy levels can cause the mobile test units to lock up) and the placing of wireless telephone base station antennas proximate to the RF communications equipment at an airport.

The invention, also in part, is a recognition that sidelobes in an antenna's radiation pattern can be selectively modified through either constructive interference, destructive interference and/or RF absorption by adding additional structures to the base plate of an antenna.

The invention, also in part according to an embodiment, provides a side-lobe-modification antenna system comprising: an antenna including a base plate and an RF radiating arrangement attached to said base plate; and a side-lobe modification bracket having a first planar surface and a second planar surface intersecting the first planar surface, said second planar surface extending aside said radiating arrangement said radiating arrangement at an angle relative to the first planar surface, said first planar surface being parallel to and abutting said base plate.

The invention, also in part according to another embodiment, provides a side-lobe-modification antenna system comprising: antenna means including base plate means and RF radiating means attached to said base plate; and side-lobe suppression means, attached to said base plate means, for suppressing a side-lobe of said antenna means.

Additional features and advantages of the invention will be more fully apparent from the following detailed description of the preferred embodiments, the appended claims and the accompanying drawings.

BRIEF DESCRIPTION OF THE DRAWINGS

The accompanying drawings are: intended to depict example embodiments of the invention and should not be interpreted to limit the scope thereof; and not to be considered as drawn to scale unless explicitly noted.

FIG. 4 is a plot of a known antenna's baseline horizontal and vertical radiation patterns.

FIG. 5 is performance plot of the baseline characteristics of the antenna of FIG. 4.

FIGS. 6–9 are performance plots of antenna systems according to embodiments of the invention that incorporate/modify the antenna of FIG. 4.

DETAILED DESCRIPTION OF THE PREFERRED EMBODIMENTS

Figure 1:
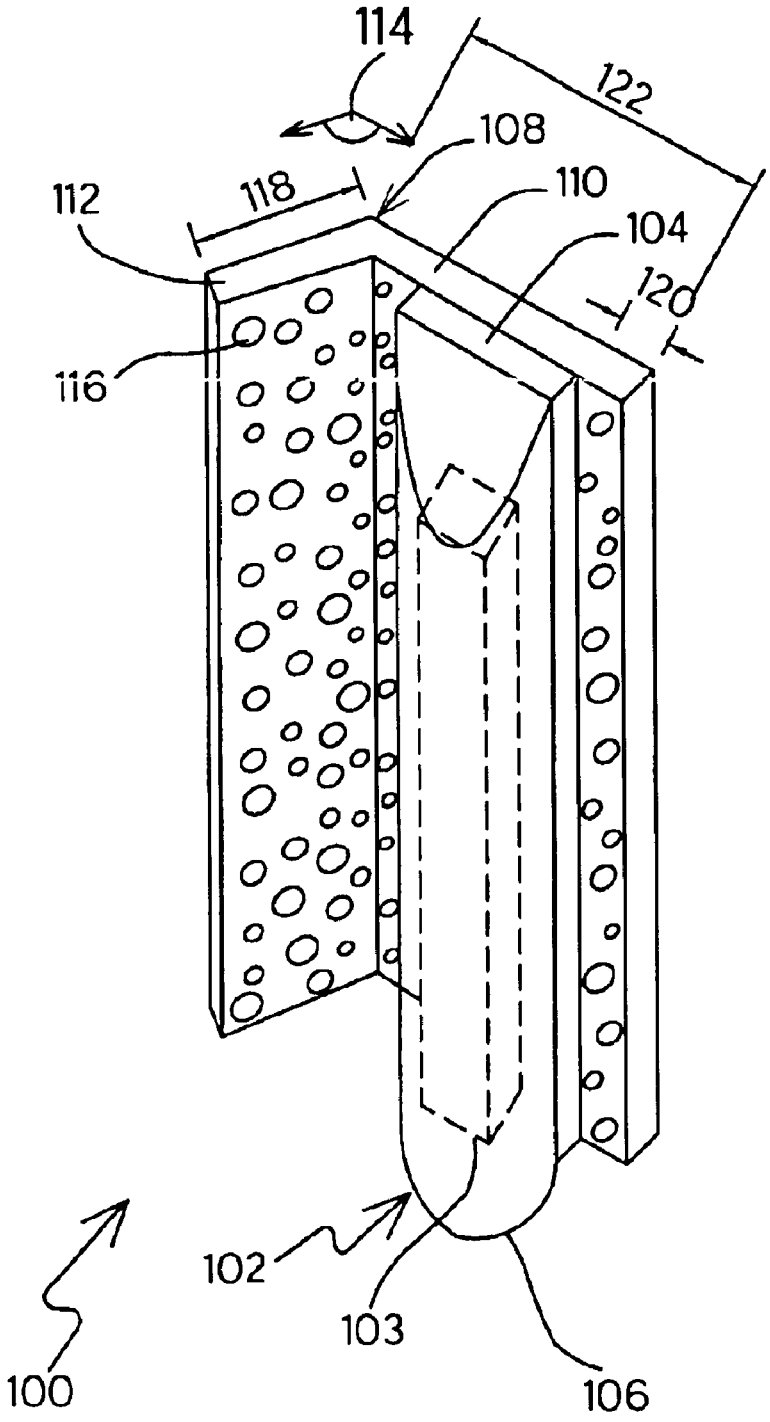
FIG. 1 is a three-quarter perspective view of an antenna system according to a first embodiment of the invention.

FIG. 1 is a three-quarter perspective view of an antenna system according to a first embodiment of the invention. In FIG. 1, an antenna system 100 includes an antenna 102 and a sidelobe modifier bracket 108. The antenna 102 includes a radio frequency ("RE") radiating arrangement 103 attached to a base plate 104. Any electrically-conductive fastener (not depicted) can be used to attach the bracket 108 to the base plate 104.

The radiating arrangement 103 is covered by a radome 106. Together, the radome 106 and the base plate 104 enclose the radiating arrangement 103; hence the radiating arrangement 103 is depicted in phantom lines.

The radiating arrangement can be any type of RF radiator, e.g., a multiple array dipole, a standard vertical radiator, a log periodic radiator, a steerable dynamic patch, etc. In other words, the particular design, type and/or configuration of the antenna is not critical. Rather, the radiating arrangement should exhibit at least one sidelobe in its azimuthal radiation pattern for which modification is desired, such modification being: enhancement and/or reshaping via constructive interference; or suppression and/or reshaping via destructive interference and/or RF absorption. For example, a sidelobe modification bracket can be positioned to effect the azimuth direction where a targeted sidelobe of the antenna's azimuthal radiation pattern otherwise would peak. Targeted sidelobes can be redirected as much as about 1200 from the main antenna primary lobe.

The base plate 104 is typically the portion of the antenna to which mounting hardware (not shown) is attached. The base plate 104 is also typically metallic, and hence typically near the radiating arrangement 103. Also, typically, but not necessarily, the base 104 is not electrically connected to the radiating arrangement 103.

The sidelobe modifier bracket 108 extends aside the RF radiating arrangement 103. The bracket 108 has a first planar surface 110 and a second planar surface 112. The first planar surface 110 is parallel to and abuts the base plate 104. The second planar surface 112 intersects the first planar surface 110 at an angle 114. Alternatively, a curved portion (not shown) could be used to connect the second planer surface 112 to the first planer surface 110.

The bracket 108 can be made to be the same length along the long axis of the antenna 102 as the antenna 102 itself. The second planar surface 112 has a width 118. The first planar surface 110 has a width 122 that can be wider than the base plate 104, and further can extend symmetrically aside the base plate a distance 120 on either side of the base plate 104.

The thickness of bracket 108 can be the same as the base plate 104. The bracket 108 can be metallic, e.g. aluminum. Hence, it can be also be electrically connected to the base plate 104, and therefore also the radiating arrangement 103.

The value of the angle 114 and the value of the widths 118 and 122 should depend upon the frequency for which the RF radiating arrangement 103 is optimized for transmitting. This will discussed more below. In FIG. 1, the angle 114 is depicted as being about 45°, for example.

The bracket 108 includes optional holes 116. The holes 116 reduce the wind load or resistance represented by the planar surface 112. Care should be taken in selecting the size of the holes. Preferably that holes are not made large enough to effect the RF surface current, i.e., to act as aperture radiators. For example, if the holes are kept equal to or smaller than two tenths (2/10) of the wavelength for which the RF radiating arrangement 103 is optimized for transmitting., then the effect will be as if the bracket 108 were a solid structure not having any holes. Holes are preferred over slits because slits can act as non-linear radiators.

Figure 2:
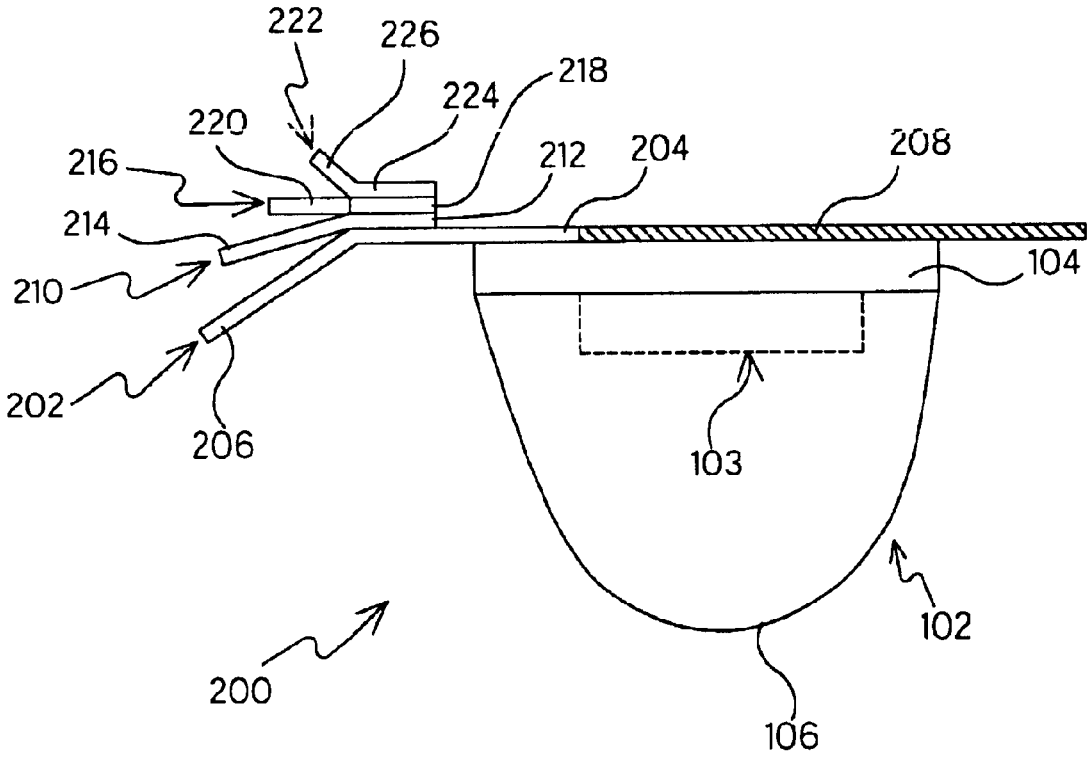
FIG. 2 is a cross-sectional view of an antenna system according to a second embodiment of the invention.

FIG. 2 is a cross-sectional view of an antenna system 200 according to a second embodiment of the invention. In FIG. 2, a sidelobe modifier bracket 202 is depicted, where the bracket 202 is similar to the bracket 108. The bracket 202 has a first planar surface 204 and a second planar surface 206. Unlike the bracket 108, the first planar surface 204 does not extend completely across the base plate 104. Rather, the first planar surface 204 is sufficiently wide so as to have overlap with the base plate 104 enough to provide a stable mechanical connection. Alternatively, the first planar surface can be extended in a manner similar to the first planar surface 110 of FIG. 1 and this is shown by the phantom part 208.

The system 200 further includes an optional second sidelobe modifier bracket 210, an optional third sidelobe modifier bracket 216 and an optional fourth sidelobe modifier bracket 222. It has been found that multiple sidelobe modification brackets tend to produce better results than a single sidelobe modification bracket. The second bracket 210 includes a third planar surface 212 and an intersecting fourth planar surface 214. The third bracket 216 represents a fifth planar surface having a first portion 218 and a second portion 220. The fourth bracket 222 includes a sixth planar surface 224 and a seventh planar surface 226.

Each of the brackets 202, 210, 216 and 222 extend aside the base plate 104. In combination with the antenna 102, the system in FIG. 2 can be described as asymmetric about a plane coplanar to the long axis of the antenna 102 and perpendicular to the base plate 104. The brackets 202, 210, 216 and 222 of FIG. 2 can be described as lending a finned appearance to the antenna system 200.

The second planar surface 206 and the fourth planar surface 214 extend to the same side of the base plate 104 as is located the RF radiating arrangement 103. The whole of each of the third bracket 216 and the fourth bracket 220 are located on the opposite side of the base plate as the RF radiating arrangement 103.

In FIG. 2, as with FIG. 1, the angles between the planar surfaces of the respective brackets as well as the widths of the planar surfaces 206, 214, 226 and portion 220 will depend upon the frequency for which the RF radiating arrangement 103 is optimized for transmitting. This will be discussed more below. In FIG. 2, the angle between the first planar surface 204 and the second planar surface 206 ("the angle of the bracket" 202) is about 45°, the angle of the bracket 210 is about 22.5°, the angle of the bracket 216 is 0° and the angle of the bracket 222 is −45°, for example. The width of the fourth planar surface 214 is about ¾ of the width of the second planar surface 206, for example. The width of the second portion 220 is about ½ of the width of the second planar surface 206, for example. The width of the seventh planar surface 226 is about ¼ of the width of the second planar surface 206, for example.

In FIG. 2, the third planar surface 212, the first portion 218 and the sixth planar surface 224 have been shown as being about the same width and having their ends in a stacked alignment. It is not necessary that these planar surfaces be the same width nor that their ends be aligned.

Figure 3:
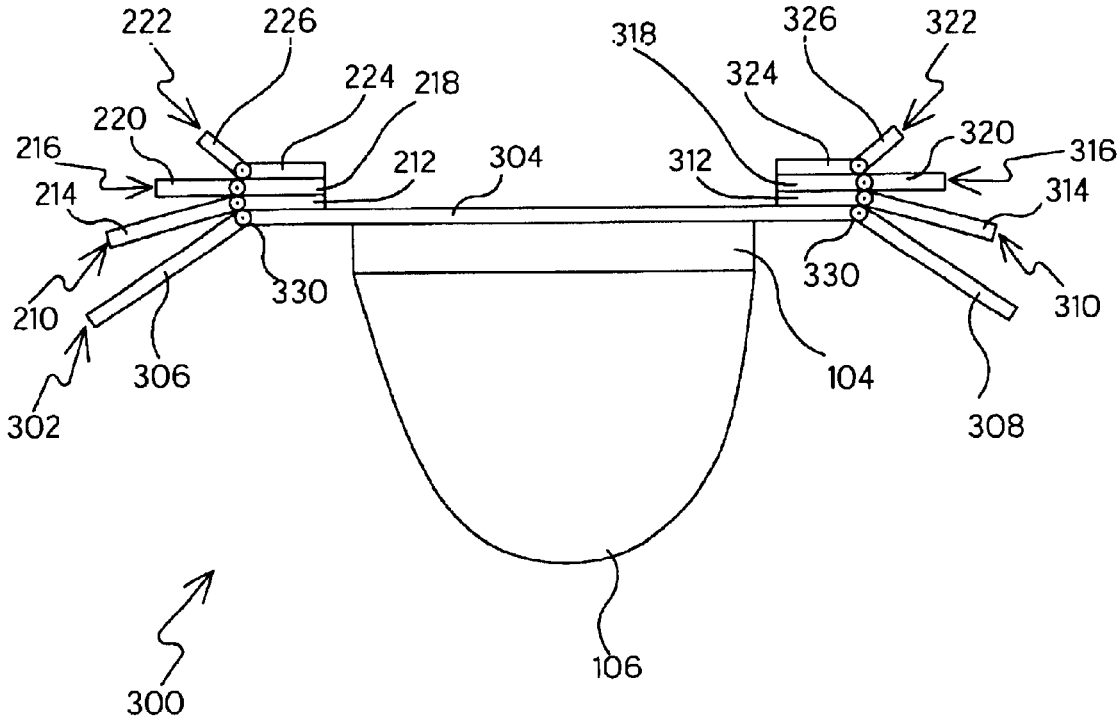
FIG. 3 is a cross-sectional view of an antenna system according to a third embodiment of the invention.

FIG. 3 is a cross-sectional view of an antenna system according to a third embodiment of the invention. In FIG. 3, a sidelobe modifier bracket 302 is depicted, where the bracket 302 is similar in some respects to the bracket 202. The bracket 302 has a first planar surface 304 and a second planar surface 306. Unlike the bracket 202, the first planar surface 304 extends completely across the base plate 104. Moreover, the first planar surface 304 extends aside the base plate 104 on the opposite side as extends the second planar surface 306.

To maintain consistency between the terminology used to describe FIG. 2, the ordinal numbering will be consecutive. Hence, for example, the bracket 304 has an eighth planar surface 308 that intersects the first planar surface 302.

The system 300 further includes an optional fifth sidelobe modifier bracket 310, an optional sixth sidelobe modifier bracket 316 and an optional seventh sidelobe modifier bracket 322. The fifth bracket 310 includes a ninth planar surface 312 and an intersecting tenth planar surface 314. The sixth bracket 316 represents a eleventh planar surface having a third portion 318 and a fourth portion 320. The seventh bracket 322 includes a twelfth planar surface 324 and a thirteenth planar surface 326. Each of the brackets 310, 316 and 322 extend aside the base plate 104.

The fifth bracket 310 corresponds to the second bracket 210, the sixth bracket 316 corresponds to the third bracket 216, and the seventh bracket 322 corresponds to the fourth bracket 222. In contrast to the system 200 of FIG. 2, the system 300 of FIG. 3 can be described as symmetric about a plane coplanar to the long axis of the antenna 102 and perpendicular to the base plate 104.

The eighth planar surface 306 and the tenth planar surface 314 extend to the same side of the base plate 104 as is located the RF radiating arrangement 103. The whole of each of the sixth bracket 316 and the seventh bracket 320 are located on the opposite side of the base plate as the RF radiating arrangement 103.

In FIG. 3, as with FIG. 2, the angles between the planar surfaces of the respective brackets as well as the widths of the planar surfaces 206, 214, 226 and portion 220 will depend upon the frequency for which the RF radiating arrangement 103 is optimized for transmitting. This will be discussed more below. In FIG. 3, the angle between the first planar surface 304 and the eighth planar surface 308 ("the angle of the bracket" 202) is about 45°, the angle of the bracket 310 is about 22.5°, the angle of the bracket 316 is 0° and the angle of the bracket 322 is −45°, for example. The width of the tenth planar surface 314 is about ¾ of the width of the eighth planar surface 308, for example. The width of the fourth portion 320 is about ½ of the width of the eighth planar surface 308, for example. The width of the fourteenth planar surface 326 is about ¼ of the width of the eighth planar surface 308, for example.

In FIG. 3, as in FIG. 2, the ninth planar surface 312, the third portion 318 and the twelfth planar surface 324 have been shown as being about the same width and having their ends in a stacked alignment. It is not necessary that these planar surfaces be the same width nor that their ends be aligned.

Another difference between FIG. 3 and FIG. 2 is that the brackets of FIG. 3 are shown as having an optional rotatable/rotary coupling 330. The rotary coupling 330 allows the angle of the bracket of which it is a part to be adjusted easily, which can be advantageous during an empirical determination of bracket angles (to be discussed more below). The coupling 330 can also incorporate a releasable friction mechanism that can be used to preserve the optimal angle of the bracket once the optimal angle has been determined.

In any of FIGS. 1, 2 or 3, one or more of the sidelobe modifier brackets can be coated with an RF absorptive or load material that converts RF energy into thermal energy (manifested as an elevated temperature). An example of such an absorptive material is the FERRITE ABSORBER brand of RF absorptive material made available by EMERSON & CUMMING MICROWAVE PRODUCTS NV.

As mentioned above, the angles between the planar surfaces of the respective brackets as well as the widths of the planar surfaces will depend upon the frequency for which the RF radiating arrangement 103 is optimized for transmitting. As is known, the wavelength ($\lambda$) of an electromagnetic ("EM") wave obeys the equation $\lambda=C/f$, where C is the propagation speed and f is the frequency of the wave. When an EM wave propagates in air, C is the speed of light. But when an EM wave propagates on the surface of a conductor, C is less than the speed of light. For example, an EM wave propagates at about 9/10 the speed of light when propagating in a coaxial cable.

As a practical matter, if a fixed frequency is input to an antenna, the corresponding $\lambda$ of the EM wave on the surface of the conductor will be smaller than when the wave that travels through the air. As a result, the widths of the planar surfaces, e.g., 112, 202, 302 and 308 can be fractions of $\lambda$, width modified by the small change in $\lambda$, and should not be even whole number fractions, e.g., ½, ¼, ⅛, 1/16, etc. In FIGS. 2 and 3 above, for examples, the width of the planar surfaces 306 and 308 can be about ½ $\lambda$, the widths of the planar surfaces 214 and 314 is about ¼ $\lambda$, the widths of portions 220 and 320 is about ⅛ $\lambda$, and the widths of planar surfaces 226 and 326 is about 1/16 $\lambda$.

The initial angle values for the one or more brackets are selected to correspond to the angle(s) of the targeted sidelobe(s). The angles of the targeted sidelobes can be determined from the antenna manufacturer's radiation pattern print-outs showing the sidelobe positions and magnitudes.

After the initial values for the angles of the brackets and the widths of the planar surfaces of the brackets are selected, a test signal is fed to the antenna system incorporating the sidelobe modification brackets and partial or complete azimuthal radiation pattern is measured. If the modified radiation pattern is acceptable, then no further design work is needed. But if the radiation pattern still exhibits one or more undesirable sidelobes, then the angles and/or widths are adjusted and the new radiation pattern is measured, etc. In other words, the optimal angles and widths are empirically determined.

Some proof-of-principle testing has been conducted using the example of an 800 MHz log periodic antenna, Model No. 7131.16.33.00, Description No. A-800-40-18i, brand of log periodic antenna made available by the ALLGON corporation. The antenna was mounted on a structural tripod that represents the actual conditions that would be deployed, e.g., on a firewater tank site vis-a-vis a nearby wireless laboratories. An Electromagnetic Compatibility (EMC) testing antenna was used to detect the site antenna test signal and deliver it to the Electromagnetic Interference (EMI) receiver of the Outside Antenna Testing System (OATS) facility. The roof of the OATS facility was used as the testing site since it provided unrestricted free space conditions with a robust ground plane reference turn-table.

Two sidelobe modifier brackets (not depicted) were attached to the base plate of the antenna. The first corresponded to bracket 202 and the second corresponded to bracket 210. The width of the planar surface corresponding to the second planar surface 206 was set at 6.843 inches. The width of the planar surface corresponding to the fourth planar surface 210 was 3.670 inches. Both brackets were about the same length as the tested antenna, namely about 52 inches. The holes in the brackets were of various diameters (all in inches): 0.075; 0.875; 1.000; 1.210; 1.250; and 1.549 to accommodate wind loading and electromagnetic characteristics.

Because test facility scheduling opportunities were limited, discrete angular antenna azimuth positions were selected as the most appropriate testing points to ensure acceptable data values and reduce the complexity of the equipment set-up. The sidelobe modifier bracket was installed at different angular positions on the ALLGON antenna ground plane plates for each set of antenna horizontal rotation tests. Data values were recorded at 15-degree intervals throughout the 180-degree sweep arc. Knowing that the antenna has symmetry about its forward azimuth axis, it was only necessary to record half of the discrete set of data points to determine the antenna radiation pattern. RF radiation levels were then recorded at each interval position. The sidelobe modifier bracket was installed at four different angular positions to assess uniformity of directivity and effect upon sidelobes.

FIG. 4 represents the tested antenna's typical horizontal and vertical radiation patterns. Included in FIG. 4 is the area of interest for the operating performance of the sidelobe modifier bracket. This area represents radiation pattern values that can contribute to RF interference within the nearby wireless laboratories. FIG. 5 is a plot of the basic site antenna without the sidelobe modifier bracket installed. The general course plot indicates the principal measurement positions taken during the test. All other plot runs are referenced to FIG. 5.

FIG. 6 is a plot with the sidelobe modifier bracket installed at the 30° degree forward position. The dashed line represents the departure from the reference antenna plot. As can be seen, the sidelobe modifier bracket starts to influence the main antenna pattern at the 45-degree position and continues to about 145 degrees. FIG. 7 shows the effect when the sidelobe modifier bracket is positioned at 90°. Again, the same area of influence is affected but to different degrees. This confirms the ability to adjust the sidelobe modifier bracket for maximum effectiveness. FIG. 8 shows the sidelobe modifier bracket positioned at 45° back from the main lobe zero position. FIG. 9 is a plot with the sidelobe modifier bracket positioned at the 45° forward position. FIG. 9 suggests that mounting positions forward of 45° has little if any influence on the tested antenna's baseline performance characteristics.

This proof-of-principle testing demonstrates that the sidelobe modifier bracket according to the various embodiments of the invention has the advantage that is functional and has the ability to modify the sidelobe baseline performance characteristics of an antenna as required; reducing undesired RF side-lobe interference.

In addition to modifying targeted sidelobes, use of the sidelobe modifier bracket(s) according to the various embodiments of the invention can confer the advantage that the front-to-back ratio of the antennas with which the brackets are combined can be improved. The test figures also indicate where the sidelobes can be adjusted to provide greater sidelobe radiated power at specific azimuth positions.

The use of the sidelobe modifier bracket according to the various embodiments of the invention can confer an advantage of being able to modify an off-the-shelf antenna to more closely suit the radiation pattern needs/restrictions of a particular physical circumstance at a much lower cost and/or in a shorter time frame than if a custom-made antenna was fabricated for the particular physical circumstance.

The invention may be embodied in other forms without departing from its spirit and essential characteristics. The described embodiments are to be considered only non-limiting examples of the invention. The scope of the invention is to be measured by the appended claims. All changes which come within the meaning and equivalency of the claims are to be embraced within their scope.

What is claimed:

1. A side-lobe-modification antenna system comprising:

an antenna including a base plate, and an RF radiating arrangement attached to said base plate; and a first side-lobe modifier bracket having a first planar surface and a second planar surface intersecting the first planar surface, said second planar surface extending aside said base plate at a first angle relative to the first planar surface, said first planar surface being parallel to and abutting said base plate; and a second side-lobe modifier bracket having a third planar surface and a fourth planar surface intersecting said third planar surface proximal to the intersection of said first and second planar surfaces, said fourth planar surface extending aside said base plate at a second angle relative to the third planar surface, said third planar surface being parallel to said base plate.

2. The system of claim 1, wherein said base plate has a long axis relative to a width axis; and wherein said first surface of said bracket is substantially the same length in the direction of the long axis as is the base plate.

3. The system of claim 1, wherein said base plate has a width axis relative to a long axis; and wherein said first surface of said bracket is substantially the same width in the direction of the width axis as is the base plate.

4. The system of claim 1, wherein said antenna further includes a radome attached to said base plate, said radome and said base plate together enclosing said radiating arrangement.

5. The system of claim 1, wherein said second planar surface extends to the same side of the first planar surface as is located the base plate.

6. The system of claim 1, wherein said angle is about 45°.

7. The system of claim 1, wherein said second angle is different than said first angle.

8. The system of claim 7, wherein said second angle is about 22.5°.

9. The system of claim 1, wherein said second planar surface is larger than said fourth planar surface.

10. The system of claim 1, further comprising:

a third side-lobe modifier bracket having a filth planar surface extending aside said base plate while being parallel to and abutting a side of said third planar surface opposite to the first planar surface.

11. The system of claim 10, wherein said second planar surface is larger than said fourth planar surface;

wherein said fifth planar surface has a first portion overlapping said third planar surface of said second modifier bracket and a second portion extending aside said first portion; and wherein said fourth planar surface is larger than said second portion.

12. The system of claim 10, further comprising:

a fourth side-lobe modifier bracket having a sixth planar surface and a seventh planar surface intersecting the sixth planar surface, said sixth planar surface extending aside said base plate and to the opposite side of said base plate as said radiating arrangement, said sixth planar surface extending at a third angle relative to the seventh planar surface, said seventh planar surface being parallel to and abutting said fifth planar surface of said third modifier bracket.

13. The system of claim 12, wherein said third angle is about 45°.

14. The system of claim 12, wherein said second planar surface is larger than said fourth planar surface;

wherein said fifth planar surface has a first portion overlapping said third planar surface of said second modifier bracket and a second portion extending aside said first portion;

wherein said fourth planar surface is larger than said second portion; and wherein said second portion is larger than said seventh planar surface.

15. The system of claim 1, wherein said angle is a first angle; and wherein said modifier bracket includes a fifth planar surface extending aside said base plate from said first planar surface at an end opposite the end from which said second planar surface extends, said fifth planar surface extending at a second angle relative to the first planar surface.

16. The system of claim 15, wherein said first and fifth planar surfaces extend to the same side of the first planar surface as is located said base plate.

17. The system of claim 15, wherein said second angle is about 45°.

18. The system of claim 1, wherein said bracket is coated in an RF-absorbing material.

19. The system of claim 1, wherein said bracket is made of aluminum.

20. The system of claim 1, wherein a plurality of holes are formed in said bracket so as to reduce a wind load represented by said bracket.

21. The system of claim 1, wherein said bracket includes a rotatable coupling to connect said first planar surface to said second planar surface such that said angle is adjustable.

22. A side-lobe-modification antenna system comprising:

antenna means including base plate means, and

RF radiating means attached to said base plate; and side-lobe modifier means, attached to said base plate means, for suppressing a side lobe of said antenna means;

said modifier means having a finned appearance that includes at least two fins extending from substantially the same side of said base plate means.

23. The system of claim 22 wherein said modifier means extends aside said base plate means.

24. The system of claim 22, wherein a cross section of said modifier means, taken perpendicular to a long axis of said antenna means, is asymmetric about a plane coplanar to said long axis and perpendicular to said base plate means.

25. The system of claim 22, wherein a cross section of said modifier means, taken perpendicular to a long axis of said antenna means, is symmetric about a plane coplanar to said long axis and perpendicular to said base plate means.

26. The system of claim 1, wherein said third planar surface abuts a side of said first planar surface opposite to the base plate.

27. The system of claim 22, wherein said at least two fins extend radially from substantially the same point of origin.

* * * * *